US010968520B2

(12) United States Patent
Shinozaki et al.

(10) Patent No.: US 10,968,520 B2
(45) **Date of Patent: *Apr. 6, 2021**

(54) TREATMENT LIQUID FOR BLACK TRIVALENT CHROMIUM CONVERSION COATING, TRIVALENT CHROMIUM-CONTAINING WATER-SOLUBLE LIQUID FOR FINISHING TREATMENT, AND TREATMENT METHOD OF METAL SUBSTRATE

(71) Applicant: Nippon Hyomen Kagaku Kabushiki Kaisha, Tokyo (JP)

(72) Inventors: Kazuyuki Shinozaki, Chigasaki (JP); Mitsuomi Katori, Chigasaki (JP); Hiroyuki Kaneta, Chigasaki (JP)

(73) Assignee: Nippon Hyomen Kagaku Kabushiki Kaisha, Tokyo (JP)

( * ) Notice: Subject to any disclaimer, the term of this patent is extended or adjusted under 35 U.S.C. 154(b) by 338 days.

This patent is subject to a terminal disclaimer.

(21) Appl. No.: 14/957,881

(22) Filed: Dec. 3, 2015

(65) Prior Publication Data

US 2016/0208390 A1 Jul. 21, 2016

(30) Foreign Application Priority Data

Jan. 16, 2015 (JP) ..... JP2015-006568

(51) Int. Cl.

| | |
|---|---|
| ***C23C 22/30*** | (2006.01) |
| ***C23C 22/53*** | (2006.01) |
| ***C23C 22/06*** | (2006.01) |
| ***C23C 22/46*** | (2006.01) |
| ***C23C 22/83*** | (2006.01) |
| ***C23C 22/40*** | (2006.01) |
| ***C23C 22/17*** | (2006.01) |
| ***C23C 22/07*** | (2006.01) |
| ***C23C 22/34*** | (2006.01) |
| ***C23C 22/73*** | (2006.01) |
| *C23C 22/33* | (2006.01) |

(52) U.S. Cl.

CPC ..... *C23C 22/06* (2013.01); *C23C 22/07* (2013.01); *C23C 22/17* (2013.01); *C23C 22/34* (2013.01); *C23C 22/40* (2013.01); *C23C 22/46* (2013.01); *C23C 22/53* (2013.01); *C23C 22/73* (2013.01); *C23C 22/83* (2013.01); *C23C 2222/10* (2013.01)

(58) Field of Classification Search

CPC ..... C23C 22/30; C23C 2222/10

See application file for complete search history.

(56) References Cited

U.S. PATENT DOCUMENTS

| | | | | |
|---|---|---|---|---|
| 2003/0207133 | A1 | 11/2003 | Preikschat et al. | |
| 2006/0054248 | A1 | 3/2006 | Straus | |
| 2008/0210341 | A1 | 9/2008 | Yamamoto et al. | |
| 2009/0020185 | A1* | 1/2009 | Inoue | C23C 22/30 148/250 |
| 2009/0050238 | A1* | 2/2009 | Inoue | C23C 22/47 148/22 |
| 2014/0017514 | A1* | 1/2014 | Inoue | C23C 22/17 428/656 |

FOREIGN PATENT DOCUMENTS

| | | | | |
|---|---|---|---|---|
| EP | 1318212 | A1 | 6/2003 | |
| EP | 1944390 | A1 | 7/2008 | |
| EP | 2695970 | A1 | 2/2014 | |
| JP | 58-34179 | | 2/1983 | |
| JP | 2000/509434 | A | 7/2000 | |
| JP | 2003-147544 | A | 5/2003 | |
| JP | 2003213446 | A | 7/2003 | |
| JP | 2005/194553 | A | 7/2005 | |
| JP | 2005/206872 | A | 8/2005 | |
| JP | 2005/320573 | A | 11/2005 | |
| JP | 2006-022364 | A | 1/2006 | |
| JP | 2007/100206 | A | 4/2007 | |
| JP | 2008/255407 | A | 10/2008 | |
| JP | 2012-062577 | A | 3/2012 | |
| WO | WO 2012/137680 | * | 10/2012 | C23C 22/20 |

OTHER PUBLICATIONS

Extended European Search Report in EP Application No. 16150099.6 dated Jun. 14, 2016, 8 pages.

Office Action in JP Application No. 2015-006568 dated May 22, 2018, 5 pages.

* cited by examiner

*Primary Examiner* — Lois L Zheng

(74) *Attorney, Agent, or Firm* — Marshall, Gerstein & Borun LLP

(57) ABSTRACT

Provided are a treatment liquid for a black trivalent chromium conversion coating, and a trivalent chromium-containing water-soluble liquid for finishing treatment, achieving excellent corrosion resistance and scratch resistance without containing a cobalt compound, with high stability and adequate consideration for environmental issues; and a method for treating a metal substrate using the same. The treatment liquid for a black trivalent chromium conversion coating on the surface of a metal substrate contains a trivalent chromium compound, two or more organic acids or organic acid salts, or one or more organic sulfur compounds, and nitrate ions, and contains no cobalt compound.

7 Claims, No Drawings

TREATMENT LIQUID FOR BLACK TRIVALENT CHROMIUM CONVERSION COATING, TRIVALENT CHROMIUM-CONTAINING WATER-SOLUBLE LIQUID FOR FINISHING TREATMENT, AND TREATMENT METHOD OF METAL SUBSTRATE

BACKGROUND OF THE INVENTION

Field of the Invention

The present invention relates to a treatment liquid for a black trivalent chromium conversion coating, a trivalent chromium-containing water-soluble liquid for finishing treatment, and a treatment method of a metal substrate.

Description of the Related Art

In general, zinc or zinc alloy plating is widely used as a method for rust prevention of iron materials and iron parts. Zinc is, however, a metal to rust easily, so that the direct use thereof immediately causes the occurrence of white rust, which is the rust of zinc. Accordingly, formation of a further protective coating is commonly required.

In the field of conversion coating treatment to form a protective layer, hexavalent chromating used to be frequently employed. Due to environmental problems, however, trivalent chromium conversion coating is mainly used at the present time. The art related to the field is described in prior literature such as Japanese Patent Laid-Open No. 2000-509434.

The trivalent chromium conversion coating treatment produces a coating with a transparent and colorless, pale blue, or pale yellow interference-color appearance under normal conditions. A black trivalent chromium conversion coating treatment has been developed for application in need of a black appearance with high-quality design such as those of the conventional black hexavalent chromium conversion coating.

As the method for forming a black trivalent chromium conversion coating, a method for combining a thermal reaction product of a trivalent chromium compound and a chelating agent or an organic acid capable of forming a chelate, or a thermal reaction product of a trivalent chromium compound and a carboxylic acid, with a cobalt compound, a phosphorus compound, an organic sulfur compound, and the like has been reported. The art related to the field is described in prior literature such as Japanese Patent Laid-Open No. 2005-206872, Japanese Patent Laid-Open No. 2005-194553, Japanese Patent Laid-Open No. 2007-100206, and Japanese Patent Laid-Open No. 2008-255407.

Further, in a black trivalent chromium conversion coating treatment, a trivalent chromium-containing water-soluble finishing agent (e.g. FT-190 manufactured by Nippon Hyomen Kagaku K.K.) may be applied onto the formed conversion coating, so as to improve the appearance, the corrosion resistance, and the scratch resistance. The method is commonly performed in the present time. The art related to the field is described in prior literature such as Japanese Patent Laid-Open No. 2005-320573.

A treatment liquid for a black trivalent chromium conversion coating for zinc or zinc alloy plating typically contains a cobalt compound in order to obtain a black appearance and improve the corrosion resistance. A trivalent chromium-containing water-soluble liquid for finishing treatment for use after formation of a conversion coating by black trivalent chromium conversion coating treatment also contains a cobalt compound in order to improve the corrosion resistance. Although some prior literature suggested that inclusion of cobalt would not be required, it was found that actual production products without inclusion of cobalt cannot be put to practical use in terms of all of the appearance, corrosion resistance, and scratch resistance. Accordingly, inclusion of cobalt has been required.

However, the influence of cobalt compounds on environment has been indicated. A part of cobalt compounds are already registered on the SVHC (Substance of Very High Concern) list of REACH (Registration, Evaluation, Authorization and Restriction of Chemicals) regulations. Other cobalt-containing compounds are also registered in the same way. In Japan, measures for use of cobalt have been enhanced by Industrial Safety and Health Law Enforcement Ordinance and Ordinance on Prevention of Hazards due to Specified Chemical Substances. Accordingly, use of a cobalt compound contained in the treatment liquid for a black trivalent chromium conversion coating may be also restricted in the future.

In use of a cobalt compound in combination with a trivalent chromium compound, a phosphorus compound, an organic sulfur compound, and the like, the treatment liquid left to stand without performing the steps of heating trivalent chromium and an organic acid to form a chelate causes a problem of reduction in the stability of the treatment liquid, along with occurrence of turbidity and precipitation in the treatment liquid due to reactions among the individual components.

An alternative method for obtaining a black appearance uses a compound of a transition metal such as nickel, without a cobalt compound in a treatment liquid for conversion coating. The method, however, has problems that lower corrosion resistance and scratch resistance, lower design effect and also of the black appearance, in comparison with actual conversion coatings at the production level and use of a finishing liquid containing a cobalt compound.

In view of the foregoing, it is an object of the present invention to provide: a treatment liquid for a black trivalent chromium conversion coating, and a trivalent chromium-containing water-soluble liquid for finishing treatment, achieving excellent corrosion resistance and scratch resistance without containing a cobalt compound, with high stability and adequate consideration for environmental issues; and a method for treating a metal substrate using the same.

SUMMARY OF THE INVENTION

The present inventor has found the following means as a result of intensive studies. Namely, no cobalt compound to obtain a black appearance and improve the corrosion resistance is used in a treatment liquid for a black trivalent chromium conversion coating, so as to improve the stability of the treatment liquid and deal with environmental issues. Instead of a cobalt compound, two or more organic acids or organic acid salts, or one or more organic sulfur compounds are used in combination to make a treatment liquid for a black trivalent chromium conversion coating. Further, an overcoating treatment is employed in parallel, using a trivalent chromium-containing water-soluble liquid for finishing treatment which contains one or more transition metal compounds and no cobalt compound, so that an appearance with high-quality design, excellent corrosion resistance and scratch resistance with high stability can be obtained through the treatment. The problems are thus solved based on the findings described above.

An aspect of the present invention accomplished based on the findings described above relates to treatment liquid for conversion coating on the surface of a metal substrate, more specifically, relates to a treatment liquid for a black trivalent chromium conversion coating which contains a trivalent chromium compound, two or more organic acids or organic acid salts, or one or more organic sulfur compounds, and nitrate ions, and contains no cobalt compound.

In an embodiment of the treatment liquid for a black trivalent chromium conversion coating of the present invention, the metal substrate is a zinc plated or zinc-alloy plated material.

In another embodiment of the present invention, the treatment liquid for a black trivalent chromium conversion coating contains a trivalent chromium compound, and an organic acid or an organic acid salt, or contains a thermal reaction product obtained by reacting a trivalent chromium compound with an organic acid or an organic acid salt at a temperature of 50° C. or higher and lower than the boiling point.

In yet another embodiment of the present invention, the treatment liquid for a black trivalent chromium conversion coating further contains one or more compounds of transition metal excluding cobalt.

In yet another embodiment of the present invention, the treatment liquid for a black trivalent chromium conversion coating further contains one or more phosphorus compounds.

Another aspect of the present invention relates to a liquid for finishing treatment of the surface of a black trivalent chromium conversion coating including a trivalent chromium compound and no cobalt compound, formed on a metal substrate, and more specifically relates to a trivalent chromium-containing water-soluble liquid for finishing treatment which contains a trivalent chromium compound, phosphorus oxoacid ions, one or more compounds of transition metals excluding cobalt, a silicone oil or a fluorine-containing compound or a fluorine-containing resin, and no cobalt compound.

In an embodiment of the trivalent chromium-containing water-soluble liquid for finishing treatment of the present invention, the metal substrate is a zinc plated or zinc-alloy plated material.

Yet another aspect of the present invention relates to a method for treating a metal substrate including the successive steps of: immersing a metal substrate in the treatment liquid for a black trivalent chromium conversion coating of the present invention so as to form a black trivalent chromium conversion coating on the surface of the metal substrate; and immersing the metal substrate in the trivalent chromium-containing water-soluble liquid for finishing treatment of the present invention so as to form a trivalent chromium-containing finish coating on the surface of the black trivalent chromium conversion coating.

The present invention provides: a treatment liquid for a black trivalent chromium conversion coating, and a trivalent chromium-containing water-soluble liquid for finishing treatment, achieving excellent corrosion resistance and scratch resistance without containing a cobalt compound, with high stability and adequate consideration for environmental issues; and a method for treating a metal substrate using the same.

DETAILED DESCRIPTION OF THE PREFERRED EMBODIMENTS (Treatment Liquid for Black Trivalent Chromium Conversion Coating)

The treatment liquid for a black trivalent chromium conversion coating of the present invention is a treatment liquid for conversion coating on the surface of a metal substrate, which contains a trivalent chromium compound, two or more organic acids or organic acid salts, or one or more organic sulfur compounds, and nitrate ions, and contains no cobalt compound. The metal substrate is preferably a zinc plated or zinc-alloy plated material, though not particularly limited.

The type of the trivalent chromium compound is not particularly limited, and a trivalent chromium salt such as chromium nitrate, chromium sulfate, and chromium phosphate may be used. The concentration of chromium in the treatment liquid for a black trivalent chromium conversion coating is not particularly limited, preferably in a range of 0.1 g/L to 100 g/L, more preferably in a range of 1 to 30 g/L.

The two or more organic acids or organic acid salts, which are used as substitute for a cobalt compound to obtain a black appearance, react with a metal substrate of, for example, a zinc plated material, together with other components, so as to form a black conversion coating. Although the two or more organic acids or organic acid salts are not particularly limited, preferably at least one of the organic acids or organic acid salts, more preferably two or more of the organic acids or organic acid salts, are polycarboxylic acids having a molecular weight of 500 or less including an organic acid such as malonic acid, tartaric acid, citric acid, malic acid, lactic acid, succinic acid, gluconic acid, glutamic acid, diglycolic acid, ascorbic acid, and oxalic acid, or a salt thereof. In particular, use of malonic acid or a salt of malonic acid, or use of oxalic acid or a salt of oxalic acid, in combination of another organic acid tends to exhibit both of high corrosion resistance and an excellent appearance. Although the concentration of the organic acid ions in the treatment liquid for a black trivalent chromium conversion coating is not particularly limited, the total of the organic acid ions in a range of 0.1 g/L to 100 g/L is preferred, and the total in a range of 1 g/L to 30 g/L is more preferred. With an excessively low concentration of the organic acid ions, a black appearance with lower design effect may be produced. With an excessively high concentration of the organic acid ions, economical disadvantage may be caused with little harmful effects.

The treatment liquid for a black trivalent chromium conversion coating of the present invention may contain a trivalent chromium compound and an organic acid or an organic acid salt, or may contain a thermal reaction product obtained by reacting a trivalent chromium compound with an organic acid or an organic acid salt at a temperature of 50° C. or higher and lower than the boiling point. In Japanese Patent Laid-Open No. 2008-255407, a method for obtaining the stability and appearance by forming a thermal reaction product from a trivalent chromium compound and an organic acid capable of forming a chelate is disclosed. In the present invention, although the formation of the thermal reaction product from a trivalent chromium compound and an organic acid is not necessarily required for production of a black trivalent chromium conversion coating excellent in the appearance, the corrosion resistance, and the stability of the treatment liquid, the stability may be enhanced by the formation of the thermal reaction product from a trivalent chromium compound and an organic acid.

The one or more organic sulfur compounds used as the substitute for a cobalt compound to obtain a black appearance react with a metal substrate of, for example, zinc plated material, together with other components, so as to form a black conversion coating. At least one, preferably two or more of the organic sulfur compounds are used, though the type of the compound is not particularly limited. Preferred examples thereof include a mercapto compound, a disulphide compound, thioureas, a sulphur-containing amino acid, and a salt thereof. Although the appearance with high-quality design, the highly practicable corrosion resistance, and the stability of a treatment liquid can be obtained even with use of a single compound, addition of two compounds or more allows the stability of the treatment liquid when left standing for a long term to be improved. Among them, preferred examples of the mercapto compound include thioglycolic acid, thiodiglycolic acid, thiomalic acid, thioacetic acid, dithioacetic acid, and thiopropionic acid. Preferred examples of the disulfide compound include dithiodiglycolic acid. Preferred examples of the sulfur-containing amino acid include cysteine and a salt thereof. Although the concentration of organic sulfur compounds in the treatment liquid for a black trivalent chromium conversion coating is not particularly limited, the total of sulfur content in a range of 0.01 g/L to 10 g/L is preferred, and the total in a range of 0.05 g/L to 5 g/L is more preferred. With an excessively small amount of organic sulfur compounds, the design effect in the black appearance may be lowered. With an excessively large amount, economical disadvantage may be caused with little harmful effects.

Nitrate ions are provided in the form of nitric acid or a metal salt such as sodium or potassium nitrate. The nitrate ions function as a film-forming component to form a uniform conversion coating having a certain degree of thickness. The concentration in a treatment liquid for a black trivalent chromium conversion coating is not particularly limited, and the concentration of the total of nitrate ions is preferably in the range of 0.1 to 100 g/L, more preferably 1 to 30 g/L.

According to the present invention, an appearance with high-quality design, and excellent corrosion resistance and scratch resistance can be obtained without using a cobalt compound, and the addition of one or more compounds of transition metals other than cobalt further improves the scratch resistance. In comparison with the case of using a cobalt compound, higher stability also can be achieved without precipitation in the treatment liquid. Examples of the transition metal compound include a salt of nickel, vanadium, cerium, manganese, or molybdenum. The concentration of each metal ion in the treatment liquid for a black trivalent chromium conversion coating is not particularly limited, preferably 0.1 to 100 g/L, more preferably 0.1 to 10 g/L.

In the present invention, although the appearance with high-quality design and the excellent corrosion resistance and scratch resistance can be obtained without using a phosphorus compound described in prior literature, the addition of a phosphorus compound may further improve the scratch resistance.

When a metal substrate such as a zinc plated or zinc alloy plated material is immersed in a treatment liquid for a black trivalent chromium conversion coating so as to form a black trivalent chromium conversion coating, the treatment temperature, the pH, and the treatment time in the conversion coating treatment are not particularly limited, and preferably the treatment is performed at a treatment temperature of 20 to 50° C., at a pH of 1.0 to 3.0, in a treatment time of 20 to 90 seconds. With an excessively high temperature, an excessive amount of metal substrate is dissolved. With an excessively low temperature, the quality of black appearance may be lowered due to reduction in reactivity. With a higher pH, an insufficient amount of black coating may be formed due to the lack of etching. With a shorter treatment time, a sufficient amount of black coating is not formed. With a treatment time of 90 seconds or more, the productivity may be lowered without enough effects.

(Trivalent Chromium-Containing Water-Soluble Liquid for Finishing Treatment)

The trivalent chromium-containing water-soluble liquid for finishing treatment of the present invention is a liquid for finishing treatment of the surface of a black trivalent chromium conversion coating including a trivalent chromium compound and no cobalt compound, formed on a metal substrate such as a zinc plated or zinc-alloy plated material, which contains a trivalent chromium compound, phosphorus oxoacid ions, one or more compounds of transition metals excluding cobalt, and a silicone oil or one or more fluorine-based compounds or resins, and contains no cobalt compound.

Conventionally, a trivalent chromium-containing water-soluble liquid for finishing treatment for improving the appearance, the corrosion resistance, and the scratch resistance of a black trivalent chromium conversion coating has contained a cobalt compound for improvement of the corrosion resistance and the scratch resistance. Use of a compound of at least one transition metal other than cobalt instead of the cobalt compound allows the corrosion resistance and the scratch resistance to be improved.

As a trivalent chromium compound, chromium phosphate may be used as a source for supplying trivalent chromium and a source for supplying oxoacid ions of phosphorus. The concentration of chromium in a trivalent chromium-containing water-soluble liquid for finishing treatment is not particularly limited, preferably in the range of 0.1 to 50 g/L, more preferably 1 to 10 g/L. The concentration of oxoacid ions of phosphorus in a trivalent chromium-containing water-soluble liquid for finishing treatment is also not particularly limited, preferably in the range of 0.1 to 50 g/L, more preferably 1 to 10 g/L.

Instead of a cobalt compound, at least one transition metal compound is added to the trivalent chromium-containing water-soluble liquid for finishing treatment of the present invention, so that the black appearance with high-quality design, the corrosion resistance and the scratch resistance can be obtained. Examples of the transition metal compound for use include a salt of nickel, vanadium, cerium, manganese, or molybdenum. The concentration of each metal ion in the trivalent chromium-containing water-soluble liquid for finishing treatment is not particularly limited, preferably 0.1 to 100 g/L, more preferably 0.1 to 10 g/L.

Further, a silicone oil or a fluorine-containing compound or a fluorine-containing resin may be added to the trivalent chromium-containing water-soluble liquid for finishing treatment. The liquid for finishing treatment mixed with a silicone oil or a fluorine-containing compound or a fluorine-containing resin allows the finish coating to be coated therewith. Consequently, a water-repelling function is exhibited to improve the corrosion resistance. The concentration of silicon or fluorine in a trivalent chromium-containing water-soluble liquid for finishing treatment is not particularly limited, preferably in the range of 0.05 to 5 g/L.

When the black trivalent chromium conversion coating formed on a metal substrate is further subjected to the finishing treatment, the treatment temperature, the pH, and the treatment time of the finishing treatment are not particularly limited, and preferably the treatment is performed at a treatment temperature of 20 to 50° C., at a pH of 3.0 to 6.5, in a treatment time of 5 to 60 seconds. With an excessively high temperature, the black trivalent chromium conversion coating is dissolved. With an excessively low temperature, the quality of black appearance may be lowered due to reduction in fixation. With a lower pH, the black trivalent chromium conversion coating is dissolved. With a higher pH, the quality of the black appearance may be lowered due to reduction in the stability of the liquid for finishing treatment. With a shorter treatment time, a sufficient amount of finish coating is not formed. With a treatment time of 60 seconds or more, the productivity may be lowered without enough effects.

(Treatment Method of Metal Substrate)

The treatment method of a metal substrate of the present invention includes the successive steps of: immersing a metal substrate made of zinc plated or zinc-alloy plated material or the like in the treatment liquid for a black trivalent chromium conversion coating so as to form the black trivalent chromium conversion coating on the surface of the metal substrate; and immersing the metal substrate in the trivalent chromium-containing water-soluble liquid for finishing treatment so as to form a trivalent chromium-containing finish coating on the surface of the black trivalent chromium conversion coating. The treatment method allows the coating of a metal substrate which has excellent corrosion resistance and scratch resistance and no cobalt compound to be formed using a treatment liquid having high stability, while considering environmental issues.

EXAMPLES

The present invention is further described in detail in the following with reference to Examples of the present invention. The present invention is, however, not limited to the Examples listed below.

In the following, the present invention is described with reference to Examples mainly for zinc plating on which the present invention has the most significant effects. In a testing, a specimen was first subjected to an appropriate pretreatment such as degreasing and immersing in acid. Zinc plating (HYPERZINC, manufactured by Nippon Hyomen Kagaku K.K.) was applied to the pretreated specimen, which was then immersed in nitric acid with a low concentration as an appropriate treatment. Subsequently the specimen was subjected to a treatment with a treatment liquid for a black trivalent chromium conversion coating and a treatment with a trivalent chromium-containing water-soluble liquid for finishing treatment of the present invention in this order. The pH adjustment of each treatment liquid was performed using nitric acid and sodium hydroxide.

The film thickness of the plating was controlled at 8 to 10 μm. The evaluation of corrosion resistance was performed based on a salt spray testing in accordance with JIS Z 2371. The evaluation of scratch resistance was performed based on a salt spray testing in accordance with JIS Z 2371 for the specimens scratched in an X-shape with a cutter knife after the treatment. The corrosion resistance and the scratch resistance in the salt spray testing were confirmed using 5 or 10 pieces of the specimens for each condition. On this occasion, the state at a specified time was evaluated as follows: "circle: no occurrence of corrosion in all the specimens", "triangle: occurrence of corrosion in a part of the specimens", and "X-mark: occurrence of corrosion in all the specimens".

Further, the stability of each treatment liquid was evaluated by confirming the occurrence of precipitation or turbidity in the liquid left standing after the treatment. The evaluation criteria are as follows: "circle: transparent, with no precipitation and no turbidity", "triangle: occurrence of turbidity" "X-mark: occurrence of precipitation", and "-: no evaluation due to occurrence of precipitation at an elapsed time of 240 hours".

Example 1

A zinc-plated iron plate (surface area: 1 $dm^2$) was immersed in a treatment liquid for a black trivalent chromium conversion coating, which contains 15 g/L of chromium nitrate, 1 g/L of malonic acid and 5 g/L of citric acid as organic acids, 5 g/L of thioglycolic acid as organic sulfur compound, and sodium nitrate including 20 g/L of nitric radicals, conditioned at a temperature of 30° C. and a pH of 2.0, for 30 seconds, and rinsed with water. Subsequently the iron plate was immersed in a trivalent chromium-containing water-soluble liquid for finishing treatment, which contains 20 g/L of chromium (III) nitrate, 1 g/L of ammonium vanadate, 5 g/L of malonic acid, and 0.10 g/L of a silicon oil, DK Q1-1247 manufactured by Dow Corning Toray Co., Ltd., controlled to a temperature of 30° C. and a pH of 4.0, for 10 seconds. Subsequently the specimen unwashed with water was dried, and the corrosion resistance, the scratch resistance, and the appearance thereof were evaluated. Further, the stability of the treatment liquid for a black trivalent chromium conversion coating after left standing at room temperature was evaluated by performing the testing for the second time at that point for evaluation of the corrosion resistance, the scratch resistance, and the appearance.

Examples 2 to 12

Using one of the organic acids described in Table 1 instead of malonic acid in Example 1, the testing was performed under the same conditions as in Example 1.

TABLE 1

| | |
|---|---|
| Example 2 | Oxalic acid |
| Example 3 | Tartaric acid |
| Example 4 | Malic acid |
| Example 5 | Succinic acid |
| Example 6 | Gluconic acid |
| Example 7 | Glutamic acid |
| Example 8 | Glycolic acid |
| Example 9 | Diglycolic acid |
| Example 10 | Ascorbic acid |
| Example 11 | Acetic acid |
| Example 12 | Butyric acid |

Examples 13 to 23

Using one of the organic acids described in Table 2 instead of citric acid in Example 1, the testing was performed under the same conditions as in Example 1.

TABLE 2

| | |
|---|---|
| Example 13 | Oxalic acid |
| Example 14 | Tartaric acid |
| Example 15 | Malic acid |
| Example 16 | Succinic acid |
| Example 17 | Gluconic acid |
| Example 18 | Glutamic acid |
| Example 19 | Glycolic acid |
| Example 20 | Diglycolic acid |
| Example 21 | Ascorbic acid |
| Example 22 | Acetic acid |
| Example 23 | Butyric acid |

Example 24

Using a thermal reaction product obtained from the reaction of 15 g/L of chromium nitrate, 1 g/L of malonic acid, and 5 g/L of citric acid dissolved in water at 80° C. for 60 minutes, in the treatment liquid for a black trivalent chromium conversion coating, instead of chromium nitrate and malonic acid in the treatment liquid for a black trivalent chromium conversion coating in Example 1, the testing was performed under the same conditions as in Example 1.

Examples 25 to 32

Using one of the organic sulfur compounds described in Table 3 instead of thioglycolic acid in the treatment liquid for a black trivalent chromium conversion coating in Example 1, the testing was performed under the same conditions as in Example 1.

TABLE 3

| | |
|---|---|
| Example 25 | Sodium dithiodiglycolate |
| Example 26 | Potassium dithiodiglycolate |
| Example 27 | Ammonium dithioglycolate |
| Example 28 | Thiomalic acid |
| Example 29 | Diammonium dithiodiglycolate |
| Example 30 | Cysteine |
| Example 31 | Cystine |
| Example 32 | Thiourea |

Examples 33 to 40

One of the organic sulfur compounds described in Table 4 was further added to the treatment liquid for a black trivalent chromium conversion coating, and the testing was performed under the same conditions as in Example 1.

TABLE 4

| | |
|---|---|
| Example 33 | Sodium dithiodiglycolate |
| Example 34 | Potassium dithiodiglycolate |
| Example 35 | Ammonium dithioglycolate |
| Example 36 | Thiomalic acid |
| Example 37 | Diammonium dithiodiglycolate |
| Example 38 | Cysteine |
| Example 39 | Cystine |
| Example 40 | Thiourea |

Examples 41 to 45

One of the transition metal compositions described in Table 5 was further added to the treatment liquid for a black trivalent chromium conversion coating, and the testing was performed under the same conditions as in Example 1.

TABLE 5

| | |
|---|---|
| Example 41 | Nickel sulfate |
| Example 42 | Ammonium vanadate |
| Example 43 | Cerium nitrate |
| Example 44 | Manganese sulfate |
| Example 45 | Sodium molybdate |

Examples 46 to 48

One of the phosphorus compounds described in Table 6 was added to the treatment liquid for a black trivalent chromium conversion coating, and the testing was performed under the same conditions as in Example 1.

TABLE 6

| | |
|---|---|
| Example 46 | Sodium phosphate |
| Example 47 | Sodium phosphite |
| Example 48 | Sodium hypophosphite |

Examples 49 to 58

The conditions in Example 1 were changed to those described in Table 7 for the testings.

TABLE 7

| | Chromium [g/L] | Malonic acid [g/L] | Citric acid [g/L] | Thioglycolic acid [g/L] | Nitric radical [g/L] |
|---|---|---|---|---|---|
| Example 1 | 15 | 1 | 5 | 5 | 20 |
| Example 49 | 1 | 1 | 5 | 5 | 20 |
| Example 50 | 30 | 1 | 1 | 1 | 20 |
| Example 51 | 1 | 1 | 1 | 1 | 20 |
| Example 52 | 15 | 1 | 5 | 5 | 1 |
| Example 53 | 15 | 5 | 1 | 5 | 20 |
| Example 54 | 15 | 1 | 15 | 5 | 20 |
| Example 55 | 15 | 1 | 5 | 15 | 20 |
| Example 56 | 30 | 5 | 15 | 15 | 40 |
| Example 57 | 30 | 1 | 5 | 20 | 30 |
| Example 58 | 15 | 5 | 1 | 15 | 20 |

Examples 59 to 62

In Examples 59 to 62, each of the pH in conversion coating treatment in Example 1 was changed to ph 1.5 (Example 59), pH 2.0 (Example 60), pH 2.5 (Example 61), or pH 3.0 (Example 62).

Examples 63 to 65

In Examples 63 to 65, each of the temperature in conversion coating treatment in Example 1 was changed to 20° C. (Example 63), 40° C. (Example 64), and 50° C. (Example 65).

Examples 66 to 68

In Examples 66 to 68, each of the treatment time in conversion coating treatment in Example 1 was changed to 20 seconds (Example 66), 60 seconds (Example 67), and 90 seconds (Example 68).

Examples 69 to 73

In Examples 69 to 73, with addition of one of the transition metal compounds described in Table 8 instead of ammonium vanadate in the trivalent chromium-containing water-soluble liquid for finishing treatment in Example 1, the testings were performed under the same conditions as in Example 1.

TABLE 8

| | |
|---|---|
| Example 69 | Nickel sulfate |
| Example 70 | Ammonium vanadate |
| Example 71 | Cerium nitrate |

TABLE 8-continued

| | |
|---|---|
| Example 72 | Manganese sulfate |
| Example 73 | Sodium molybdate |

Comparative Example 1

In comparative Example 1, a zinc-plated iron plate (surface area: 1 $dm^2$) was immersed in a commercially available treatment liquid for a black trivalent chromium conversion coating for zinc plating (TR-184FG (product name), manufactured by Nippon Hyomen Kagaku K.K., containing trivalent chromium, nitrate ions, an organic acid, an organic sulfur compound, and cobalt. TR-184F: 80 mL/L, TR-184G: 50 mL/L) conditioned at a temperature of 30° C. and a pH of 2.0, for 60 seconds, so that a trivalent chromium conversion coating was formed. Subsequently the iron plate was rinsed with water, and then immersed in a trivalent chromium-containing water-soluble liquid for finishing treatment (FT-190 (product name): manufactured by Nippon Hyomen Kagaku K.K., containing cobalt. FT-190: 100 mL/L) conditioned at a temperature of 40° C. and without pH adjustment, for 10 seconds. Subsequently the specimen was dried, and the corrosion resistance, the scratch resistance, and the appearance thereof were evaluated in the same way as in Examples.

Comparative Example 2

In Comparative Example 2, except that a treatment liquid for a black trivalent chromium conversion coating excluding malonic acid was used, the testing was performed under the same conditions as in Example 1.

Comparative Example 3

In Comparative Example 3, except that a treatment liquid for a black trivalent chromium conversion coating excluding citric acid was used, the testing was performed under the same conditions as in Example 1.

Comparative Example 4

In Comparative Example 4, except that a treatment liquid for a black trivalent chromium conversion coating with addition of cobalt was used, the testing was performed under the same conditions as in Example 1.

Comparative Example 5

In Comparative Example 5, except that a trivalent chromium-containing water-soluble liquid for finishing treatment excluding ammonium vanadate was used, the testing was performed under the same conditions as in Example 1.

Comparative Example 6

In Comparative Example 6, except that a trivalent chromium-containing water-soluble liquid for finishing treatment excluding DK Q1-1247 was used, the testing was performed under the same conditions as in Example 1.

The evaluation results of the appearance, the corrosion resistance, and the scratch resistance in Examples 1 to 73 and Comparative Examples 1 to 6 are described in Table 9.

TABLE 9

| | Appearance | Corrosion resistance (168 h) | Corrosion resistance (240 h) | Corrosion resistance (360 h) | Scratch resistance (168 h) | Scratch resistance (240 h) | Scratch resistance (360 h) |
|---|---|---|---|---|---|---|---|
| Example 1 | Uniform black appearance | ○ | ○ | ○ | ○ | ○ | Δ |
| Example 2 | Uniform black appearance | ○ | ○ | ○ | ○ | ○ | Δ |
| Example 3 | Uniform black appearance | ○ | ○ | ○ | ○ | ○ | Δ |
| Example 4 | Uniform black appearance | ○ | ○ | ○ | ○ | ○ | Δ |
| Example 5 | Uniform black appearance | ○ | ○ | ○ | ○ | ○ | Δ |
| Example 6 | Uniform black appearance | ○ | ○ | ○ | ○ | ○ | Δ |
| Example 7 | Uniform black appearance | ○ | ○ | ○ | ○ | ○ | Δ |
| Example 8 | Uniform black appearance | ○ | ○ | ○ | ○ | ○ | Δ |
| Example 9 | Uniform black appearance | ○ | ○ | ○ | ○ | ○ | Δ |
| Example 10 | Uniform black appearance | ○ | ○ | ○ | ○ | ○ | Δ |
| Example 11 | Uniform black appearance | ○ | ○ | ○ | ○ | ○ | Δ |

TABLE 9-continued

| | Appearance | Corrosion resistance (168 h) | Corrosion resistance (240 h) | Corrosion resistance (360 h) | Scratch resistance (168 h) | Scratch resistance (240 h) | Scratch resistance (360 h) |
|---|---|---|---|---|---|---|---|
| Example 12 | Uniform black appearance | ○ | ○ | ○ | ○ | ○ | Δ |
| Example 13 | Uniform black appearance | ○ | ○ | ○ | ○ | ○ | Δ |
| Example 14 | Uniform black appearance | ○ | ○ | ○ | ○ | ○ | Δ |
| Example 15 | Uniform black appearance | ○ | ○ | ○ | ○ | ○ | Δ |
| Example 16 | Uniform black appearance | ○ | ○ | ○ | ○ | ○ | Δ |
| Example 17 | Uniform black appearance | ○ | ○ | ○ | ○ | ○ | Δ |
| Example 18 | Uniform black appearance | ○ | ○ | ○ | ○ | ○ | Δ |
| Example 19 | Uniform black appearance | ○ | ○ | ○ | ○ | ○ | Δ |
| Example 20 | Uniform black appearance | ○ | ○ | ○ | ○ | ○ | Δ |
| Example 21 | Uniform black appearance | ○ | ○ | ○ | ○ | ○ | Δ |
| Example 22 | Uniform black appearance | ○ | ○ | ○ | ○ | ○ | Δ |
| Example 23 | Uniform black appearance | ○ | ○ | ○ | ○ | ○ | Δ |
| Example 24 | Uniform black appearance | ○ | ○ | ○ | ○ | ○ | Δ |
| Example 25 | Uniform black appearance | ○ | ○ | ○ | ○ | ○ | Δ |
| Example 26 | Uniform black appearance | ○ | ○ | ○ | ○ | ○ | Δ |
| Example 27 | Uniform black appearance | ○ | ○ | ○ | ○ | ○ | Δ |
| Example 28 | Uniform black appearance | ○ | ○ | ○ | ○ | ○ | Δ |
| Example 29 | Uniform black appearance | ○ | ○ | ○ | ○ | ○ | Δ |
| Example 30 | Uniform black appearance | ○ | ○ | ○ | ○ | ○ | Δ |
| Example 31 | Uniform black appearance | ○ | ○ | ○ | ○ | ○ | Δ |
| Example 32 | Uniform black appearance | ○ | ○ | ○ | ○ | ○ | Δ |
| Example 33 | Uniform black appearance | ○ | ○ | ○ | ○ | ○ | Δ |
| Example 34 | Uniform black appearance | ○ | ○ | ○ | ○ | ○ | Δ |
| Example 35 | Uniform black appearance | ○ | ○ | ○ | ○ | ○ | Δ |
| Example 36 | Uniform black appearance | ○ | ○ | ○ | ○ | ○ | Δ |

TABLE 9-continued

| | Appearance | Corrosion resistance (168 h) | Corrosion resistance (240 h) | Corrosion resistance (360 h) | Scratch resistance (168 h) | Scratch resistance (240 h) | Scratch resistance (360 h) |
|---|---|---|---|---|---|---|---|
| Example 37 | Uniform black appearance | ○ | ○ | ○ | ○ | ○ | Δ |
| Example 38 | Uniform black appearance | ○ | ○ | ○ | ○ | ○ | Δ |
| Example 39 | Uniform black appearance | ○ | ○ | ○ | ○ | ○ | Δ |
| Example 40 | Uniform black appearance | ○ | ○ | ○ | ○ | ○ | Δ |
| Example 41 | Uniform black appearance | ○ | ○ | ○ | ○ | ○ | ○ |
| Example 42 | Uniform black appearance | ○ | ○ | ○ | ○ | ○ | ○ |
| Example 43 | Uniform black appearance | ○ | ○ | ○ | ○ | ○ | ○ |
| Example 44 | Uniform black appearance | ○ | ○ | ○ | ○ | ○ | ○ |
| Example 45 | Uniform black appearance | ○ | ○ | ○ | ○ | ○ | ○ |
| Example 46 | Uniform black appearance | ○ | ○ | ○ | ○ | ○ | ○ |
| Example 47 | Uniform black appearance | ○ | ○ | ○ | ○ | ○ | ○ |
| Example 48 | Uniform black appearance | ○ | ○ | ○ | ○ | ○ | ○ |
| Example 49 | Non-uniform grayish black appearance | ○ | ○ | Δ | ○ | Δ | Δ |
| Example 50 | Uniform black appearance | ○ | ○ | ○ | ○ | ○ | Δ |
| Example 51 | Non-uniform grayish black appearance | ○ | Δ | Δ | Δ | Δ | Δ |
| Example 52 | Uniform black appearance | ○ | ○ | ○ | ○ | ○ | Δ |
| Example 53 | Uniform black appearance | ○ | ○ | ○ | ○ | ○ | Δ |
| Example 54 | Uniform black appearance | ○ | ○ | ○ | ○ | ○ | Δ |
| Example 55 | Uniform black appearance | ○ | ○ | ○ | ○ | ○ | Δ |
| Example 56 | Uniform black appearance | ○ | ○ | ○ | ○ | ○ | Δ |
| Example 57 | Uniform black appearance | ○ | ○ | ○ | ○ | ○ | Δ |
| Example 58 | Uniform black appearance | ○ | ○ | ○ | ○ | ○ | Δ |
| Example 59 | Uniform black appearance | ○ | ○ | ○ | ○ | ○ | Δ |
| Example 60 | Uniform black appearance | ○ | ○ | ○ | ○ | ○ | Δ |
| Example 61 | Uniform black appearance | ○ | ○ | ○ | ○ | ○ | Δ |
| Example 62 | Non-uniform grayish black appearance | Δ | Δ | Δ | Δ | Δ | Δ |
| Example 63 | Uniform black appearance | ○ | ○ | ○ | ○ | ○ | Δ |
| Example 64 | Uniform black appearance | ○ | ○ | ○ | ○ | ○ | Δ |
| Example 65 | Uniform black appearance | ○ | ○ | ○ | ○ | ○ | Δ |
| Example 66 | Uniform black appearance | ○ | ○ | ○ | ○ | ○ | Δ |
| Example 67 | Uniform black appearance | ○ | ○ | ○ | ○ | ○ | Δ |
| Example 68 | Uniform black appearance | ○ | ○ | ○ | ○ | ○ | Δ |
| Example 69 | Uniform black appearance | ○ | ○ | ○ | ○ | ○ | Δ |
| Example 70 | Uniform black appearance | ○ | ○ | ○ | ○ | ○ | Δ |

TABLE 9-continued

| | Appearance | Corrosion resistance (168 h) | Corrosion resistance (240 h) | Corrosion resistance (360 h) | Scratch resistance (168 h) | Scratch resistance (240 h) | Scratch resistance (360 h) |
|---|---|---|---|---|---|---|---|
| Example 71 | Uniform black appearance | ○ | ○ | ○ | ○ | ○ | Δ |
| Example 72 | Uniform black appearance | ○ | ○ | ○ | ○ | ○ | Δ |
| Example 73 | Uniform black appearance | ○ | ○ | ○ | ○ | ○ | Δ |
| Comparative Example 1 | Uniform black appearance | ○ | ○ | ○ | ○ | ○ | Δ |
| Comparative Example 2 | Uniform glossy black appearance | ○ | ○ | ○ | ○ | ○ | Δ |
| Comparative Example 3 | Uniform glossy black appearance | ○ | ○ | ○ | ○ | ○ | Δ |
| Comparative Example 4 | Uniform black appearance | ○ | ○ | ○ | ○ | ○ | Δ |
| Comparative Example 5 | Uniform black appearance | Δ | x | x | x | x | x |
| Comparative Example 6 | Uniform black appearance | ○ | ○ | Δ | Δ | Δ | x |

After the treatment liquid was left standing for 240 hours, the appearance, the corrosion resistance, and the scratch resistance were evaluated in Examples 1 to 73 and Comparative Examples 1 to 6. The evaluation results are described in Table 10.

TABLE 10

| | Appearance (240 h) | Stability of treatment liquid (240 h) | Stability of treatment liquid (360 h) | Corrosion resistance (168 h) | Corrosion resistance (240 h) | Scratch resistance (168 h) | Scratch resistance (240 h) |
|---|---|---|---|---|---|---|---|
| Example 1 | Uniform black appearance | ○ | Δ | ○ | ○ | ○ | ○ |
| Example 2 | Uniform black appearance | ○ | Δ | ○ | ○ | ○ | ○ |
| Example 3 | Uniform black appearance | ○ | Δ | ○ | ○ | ○ | ○ |
| Example 4 | Uniform black appearance | ○ | Δ | ○ | ○ | ○ | ○ |
| Example 5 | Uniform black appearance | ○ | Δ | ○ | ○ | ○ | ○ |
| Example 6 | Uniform black appearance | ○ | Δ | ○ | ○ | ○ | ○ |
| Example 7 | Uniform black appearance | ○ | Δ | ○ | ○ | ○ | ○ |
| Example 8 | Uniform black appearance | ○ | Δ | ○ | ○ | ○ | ○ |
| Example 9 | Uniform black appearance | ○ | Δ | ○ | ○ | ○ | ○ |
| Example 10 | Uniform black appearance | ○ | Δ | ○ | ○ | ○ | ○ |
| Example 11 | Uniform black appearance | ○ | Δ | ○ | ○ | ○ | ○ |
| Example 12 | Uniform black appearance | ○ | Δ | ○ | ○ | ○ | ○ |
| Example 13 | Uniform black appearance | ○ | Δ | ○ | ○ | ○ | ○ |

TABLE 10-continued

| | Appearance (240 h) | Stability of treatment liquid (240 h) | Stability of treatment liquid (360 h) | Corrosion resistance (168 h) | Corrosion resistance (240 h) | Scratch resistance (168 h) | Scratch resistance (240 h) |
|---|---|---|---|---|---|---|---|
| Example 14 | Uniform black appearance | ○ | Δ | ○ | ○ | ○ | ○ |
| Example 15 | Uniform black appearance | ○ | Δ | ○ | ○ | ○ | ○ |
| Example 16 | Uniform black appearance | ○ | Δ | ○ | ○ | ○ | ○ |
| Example 17 | Uniform black appearance | ○ | Δ | ○ | ○ | ○ | ○ |
| Example 18 | Uniform black appearance | ○ | Δ | ○ | ○ | ○ | ○ |
| Example 19 | Uniform black appearance | ○ | Δ | ○ | ○ | ○ | ○ |
| Example 20 | Uniform black appearance | ○ | Δ | ○ | ○ | ○ | ○ |
| Example 21 | Uniform black appearance | ○ | Δ | ○ | ○ | ○ | ○ |
| Example 22 | Uniform black appearance | ○ | Δ | ○ | ○ | ○ | ○ |
| Example 23 | Uniform black appearance | ○ | Δ | ○ | ○ | ○ | ○ |
| Example 24 | Uniform black appearance | ○ | Δ | ○ | ○ | ○ | ○ |
| Example 25 | Uniform black appearance | ○ | Δ | ○ | ○ | ○ | ○ |
| Example 26 | Uniform black appearance | ○ | Δ | ○ | ○ | ○ | ○ |
| Example 27 | Uniform black appearance | ○ | Δ | ○ | ○ | ○ | ○ |
| Example 28 | Uniform black appearance | ○ | Δ | ○ | ○ | ○ | ○ |
| Example 29 | Uniform black appearance | ○ | Δ | ○ | ○ | ○ | ○ |
| Example 30 | Uniform black appearance | ○ | Δ | ○ | ○ | ○ | ○ |
| Example 31 | Uniform black appearance | ○ | Δ | ○ | ○ | ○ | ○ |
| Example 32 | Uniform black appearance | ○ | Δ | ○ | ○ | ○ | ○ |
| Example 33 | Uniform black appearance | ○ | ○ | ○ | ○ | ○ | ○ |
| Example 34 | Uniform black appearance | ○ | ○ | ○ | ○ | ○ | ○ |
| Example 35 | Uniform black appearance | ○ | ○ | ○ | ○ | ○ | ○ |
| Example 36 | Uniform black appearance | ○ | ○ | ○ | ○ | ○ | ○ |
| Example 37 | Uniform black appearance | ○ | ○ | ○ | ○ | ○ | ○ |

TABLE 10-continued

| | Appearance (240 h) | Stability of treatment liquid (240 h) | Stability of treatment liquid (360 h) | Corrosion resistance (168 h) | Corrosion resistance (240 h) | Scratch resistance (168 h) | Scratch resistance (240 h) |
|---|---|---|---|---|---|---|---|
| Example 38 | Uniform black appearance | ○ | ○ | ○ | ○ | ○ | ○ |
| Example 39 | Uniform black appearance | ○ | ○ | ○ | ○ | ○ | ○ |
| Example 40 | Uniform black appearance | ○ | ○ | ○ | ○ | ○ | ○ |
| Example 41 | Uniform black appearance | ○ | Δ | ○ | ○ | ○ | ○ |
| Example 42 | Uniform black appearance | ○ | Δ | ○ | ○ | ○ | ○ |
| Example 43 | Uniform black appearance | ○ | Δ | ○ | ○ | ○ | ○ |
| Example 44 | Uniform black appearance | ○ | Δ | ○ | ○ | ○ | ○ |
| Example 45 | Uniform black appearance | ○ | Δ | ○ | ○ | ○ | ○ |
| Example 46 | Uniform black appearance | ○ | Δ | ○ | ○ | ○ | ○ |
| Example 47 | Uniform black appearance | ○ | Δ | ○ | ○ | ○ | ○ |
| Example 48 | Uniform black appearance | ○ | Δ | ○ | ○ | ○ | ○ |
| Example 49 | Uniform black appearance | ○ | Δ | ○ | ○ | ○ | ○ |
| Example 50 | Uniform black appearance | ○ | Δ | ○ | ○ | ○ | ○ |
| Example 51 | Uniform black appearance | ○ | Δ | ○ | ○ | ○ | ○ |
| Example 52 | Uniform black appearance | ○ | Δ | ○ | ○ | ○ | ○ |
| Example 53 | Uniform black appearance | ○ | Δ | ○ | ○ | ○ | ○ |
| Example 54 | Uniform black appearance | ○ | Δ | ○ | ○ | ○ | ○ |
| Example 55 | Uniform black appearance | ○ | Δ | ○ | ○ | ○ | Δ |
| Example 56 | Uniform black appearance | ○ | Δ | ○ | ○ | ○ | ○ |
| Example 57 | Uniform black appearance | ○ | Δ | ○ | ○ | ○ | ○ |
| Example 58 | Uniform black appearance | ○ | Δ | ○ | ○ | ○ | ○ |
| Example 59 | Uniform black appearance | ○ | Δ | ○ | ○ | ○ | ○ |
| Example 60 | Uniform black appearance | ○ | Δ | ○ | ○ | ○ | ○ |
| Example 61 | Uniform black appearance | ○ | Δ | ○ | ○ | ○ | ○ |
| Example 62 | Uniform black appearance | ○ | Δ | ○ | ○ | ○ | ○ |
| Example 63 | Uniform black appearance | ○ | Δ | ○ | ○ | ○ | ○ |
| Example 64 | Uniform black appearance | ○ | Δ | ○ | ○ | ○ | ○ |
| Example 65 | Uniform black appearance | ○ | Δ | ○ | ○ | ○ | ○ |
| Example 66 | Uniform black appearance | ○ | Δ | ○ | ○ | ○ | ○ |
| Example 67 | Uniform black appearance | ○ | Δ | ○ | ○ | ○ | ○ |
| Example 68 | Uniform black appearance | ○ | Δ | ○ | ○ | ○ | ○ |
| Example 69 | Uniform black appearance | ○ | Δ | ○ | ○ | ○ | ○ |
| Example 70 | Uniform black appearance | ○ | Δ | ○ | ○ | ○ | ○ |
| Example 71 | Uniform black appearance | ○ | Δ | ○ | ○ | ○ | ○ |

TABLE 10-continued

| | Appearance (240 h) | Stability of treatment liquid (240 h) | Stability of treatment liquid (360 h) | Corrosion resistance (168 h) | Corrosion resistance (240 h) | Scratch resistance (168 h) | Scratch resistance (240 h) |
|---|---|---|---|---|---|---|---|
| Example 72 | Uniform black appearance | ○ | Δ | ○ | ○ | ○ | ○ |
| Example 73 | Uniform black appearance | ○ | Δ | ○ | ○ | ○ | ○ |
| Comparative Example 1 | Non-uniform black appearance | Δ | Δ | ○ | Δ | ○ | Δ |
| Comparative Example 2 | Uniform glossy black appearance | ○ | ○ | ○ | ○ | ○ | ○ |
| Comparative Example 3 | Uniform glossy black appearance | ○ | ○ | ○ | ○ | ○ | ○ |
| Comparative Example 4 | Non-uniform grayish black appearance | x | — | x | x | x | x |
| Comparative Example 5 | Uniform black appearance | ○ | ○ | x | x | x | x |
| Comparative Example 6 | Uniform black appearance | ○ | ○ | Δ | Δ | Δ | x |

What is claimed is:

1. A treatment liquid for a black trivalent chromium conversion coating on the surface of a metal substrate, wherein the treatment liquid consists of:

one or more organic sulfur compounds;

nitrate ions; and a thermal reaction product obtained by reacting a trivalent chromium compound with an organic acid or organic acid salt at a temperature of 80° C. or higher and lower than the boiling point, wherein the treatment liquid is free of a cobalt compound.

2. The treatment liquid for a black trivalent chromium conversion coating according to claim 1, wherein the metal substrate is a zinc plated or zinc-alloy plated material.

3. A trivalent chromium-containing water-soluble liquid for finishing treatment of the surface of a black trivalent chromium conversion coating formed on a metal substrate by contacting the metal substrate with the treatment liquid of claim 1, said liquid for finishing treatment including a trivalent chromium compound but no cobalt compound and consisting of:

a trivalent chromium compound;

phosphorus oxoacid ions;

one or more compounds of transition metal excluding cobalt;

a silicone oil or a fluorine-containing compound or a fluorine-containing resin, but no cobalt compound.

4. The trivalent chromium-containing water-soluble liquid for finishing treatment according to claim 3, wherein the metal substrate is a zinc plated or zinc-alloy plated material.

5. A method for treating a metal substrate comprising the steps of:

immersing a metal substrate in the treatment liquid for a black trivalent chromium conversion coating according to claim 1 to form a black trivalent chromium conversion coating on the surface of the metal substrate; and immersing the metal substrate in a trivalent chromium-containing water-soluble liquid for finishing treatment to form a trivalent chromium-containing finish coating on the surface of the black trivalent chromium conversion coating, wherein the trivalent chromium-containing water-soluble liquid for finishing treatment comprises:

a trivalent chromium compound;

phosphorus oxoacid ions;

one or more compounds of transition metal excluding cobalt;

a silicone oil or a fluorine-containing compound or a fluorine-containing resin, but no cobalt compound.

6. A treatment liquid for a black trivalent chromium conversion coating on the surface of a metal substrate, wherein the treatment liquid consists of:

one or more organic sulfur compounds;

nitrate ions;

a thermal reaction product obtained by reacting a trivalent chromium compound with an organic acid or organic acid salt at a temperature of 80° C. or higher and lower than the boiling point, and one or more compounds of transition metal excluding cobalt, wherein the treatment liquid is free of a cobalt compound.

7. A treatment liquid for a black trivalent chromium conversion coating on the surface of a metal substrate, wherein the treatment liquid consists of:

one or more organic sulfur compounds;

nitrate ions;

a thermal reaction product obtained by reacting a trivalent chromium compound with an organic acid or organic acid salt at a temperature of 80° C. or higher and lower than the boiling point, and one or more phosphorus compounds selected from the group consisting of sodium phosphate, sodium phosphite, and sodium hypophosphite, wherein the treatment liquid is free of a cobalt compound.

* * * * *